US011514841B2

(12) United States Patent
Haas et al.

(10) Patent No.: US 11,514,841 B2
(45) Date of Patent: Nov. 29, 2022

(54) VISUAL DISPLAY UNIT FOR PROCESSING A DOUBLE INPUT SIGNAL

(71) Applicant: MICROOLED, Grenoble (FR)

(72) Inventors: Gunther Haas, Saint-Egreve (FR); Laurent Charrier, Grenoble (FR)

(73) Assignee: MICROOLED, Grenoble (FR)

( * ) Notice: Subject to any disclaimer, the term of this patent is extended or adjusted under 35 U.S.C. 154(b) by 72 days.

(21) Appl. No.: 17/050,477

(22) PCT Filed: May 15, 2019

(86) PCT No.: PCT/FR2019/051100
§ 371 (c)(1),
(2) Date: Oct. 26, 2020

(87) PCT Pub. No.: WO2019/220055
PCT Pub. Date: Nov. 21, 2019

(65) Prior Publication Data

US 2021/0241679 A1 Aug. 5, 2021

(30) Foreign Application Priority Data

May 16, 2018 (FR) ..... 1854079

(51) Int. Cl.
*G09G 3/30* (2006.01)
*G09G 3/32* (2016.01)

(52) U.S. Cl.
CPC ..... *G09G 3/32* (2013.01); *G09G 2300/0857* (2013.01); *G09G 2340/125* (2013.01)

(58) Field of Classification Search
CPC ..... G09G 3/32
(Continued)

(56) References Cited

U.S. PATENT DOCUMENTS 5,952,991 A * 9/1999 Akiyama ..... G09G 3/3659 345/98
8,502,758 B2 * 8/2013 Beland ..... G09F 9/33 345/55

(Continued)

FOREIGN PATENT DOCUMENTS

WO 2014/108741 A1 7/2014

OTHER PUBLICATIONS

International Search Report, dated Aug. 28, 2019, corresponding to International Application No. PCT/FR2019/051100.

(Continued)

*Primary Examiner* — Thomas J Lett
(74) *Attorney, Agent, or Firm* — Ladas & Parry LLP; Malcolm J. MacDonald

(57) ABSTRACT

An electroluminescent visual display unit having: a matrix of electroluminescent pixels formed from pixels arranged on a substrate, in a matrix arrangement in lines and columns, each pixel being formed by an elementary emitting zone; a first control block to control a graphic and/or alphanumeric data stream that can be displayed on the matrix of pixels; a second control block to control a video data stream that can be displayed on the matrix of pixels; and a unit for generating a reference voltage, the device being characterized in that: each elementary emitting zone is connected to a static memory, addressed by the first control block, and to a dynamic memory, addressed by the second control block; the first and second control blocks for displaying data alternately or simultaneously on the same matrix of pixels.

16 Claims, 5 Drawing Sheets

(58) Field of Classification Search
USPC ..... 345/531
See application file for complete search history.

(56) References Cited

U.S. PATENT DOCUMENTS

| | | | | |
|---|---|---|---|---|
| 11,157,111 | B2 * | 10/2021 | McCoy | G06F 3/038 |
| 2002/0093472 | A1 * | 7/2002 | Numao | G09G 3/3659 345/87 |
| 2004/0095305 | A1 | 5/2004 | Kimura et al. | |
| 2009/0027306 | A1 | 1/2009 | Kawabe | |
| 2009/0102749 | A1 | 4/2009 | Kawabe | |
| 2011/0140999 | A1 * | 6/2011 | Beland | G06F 3/1446 345/82 |
| 2019/0064953 | A1 * | 2/2019 | McCoy | G06F 3/03542 |

OTHER PUBLICATIONS

Wacyk, I., et al.; "Ultra High Resolution AMOLED", published in Proc. SPIE 8042, Display Technologies and Applications for Defense, Security, and Avionics V; and Enhanced and Synthetic Vision 2011, 80420B (doi: 10.1117/12.886520).

Vogel, Uwe, et al.; "Ultra-low Power OLED Microdisplay for Extended Battery Life", published in SID 2017 Digest, pp. 1125-1128.

* cited by examiner

VISUAL DISPLAY UNIT FOR PROCESSING A DOUBLE INPUT SIGNAL

TECHNICAL FIELD OF THE INVENTION

The invention relates to the field of electronics, and more specifically that of matrix display units. It relates to a LED, OLED or any other type of matrix display unit. This matrix display unit makes it possible to dynamically or statically display images, or overlay these two display types; in order to make this double display possible, it comprises a new architecture of each sub-pixel.

PRIOR ART

Matrix display unit systems are known that implement on each sub-pixel a different architecture according to the type of static or dynamic display desired on the interface.

The publication "*Ultra High Resolution AMOLED*" by Wacyk et al., published in Proc. SPIE 8042, Display Technologies and Applications for Defense, Security, and Avionics V; and Enhanced and Synthetic Vision 2011, 80420B (doi: 10.1117/12.886520), describes a circuit of the active matrix type with an architecture of the analog memory type. This type of circuit is perfectly suitable for displaying video image sources, because these circuits need periodic addressing, in the order of 25 Hz to 125 Hz, in order not to lose information. On the other hand, in this circuit, the static display generates excessive consumption because its architecture is dedicated to a dynamic display.

Then again, the publication "Ultra-low Power OLED *Microdisplay for Extended Battery Life*" by Uwe Vogel et al., published in SID 2017 Digest, p. 1125-1128, describes a memory cell matrix circuit, of the SRAM (Static Random Access Memory) type. In this circuit, the image is stored in memory in a memory matrix and the state of the latter only changes when the data to be displayed changes. This type of circuit does not need to be refreshed periodically, it is a static display that is perfectly suitable for displays of the graphic type. Its main advantages are low consumption for static images or low change rate as well as the possibility of addressing the matrix directly by a microcontroller without passing through a video controller.

WO 2014/108741 describes a method for overlaying the two static and dynamic modes for producing the display of a dynamic or static source on the same display unit. The unit comprises a data processing unit for adapting the signals for display on the display matrix. Said post-processing of data makes it possible to produce an overlay, but it is based on a dynamic display unit; consequently, the energy consumption of the unit remains significant. Another unit for the overlaying of images is described in US 2002/0093472.

Given the foregoing, one aim of the present invention is to remedy, at least partially, the drawbacks of the prior art mentioned above by proposing a display unit with very low consumption such as for the static mode but that also makes possible the dynamic display (video mode) of very good quality. This display unit should also make it possible to easily overlay graphic images (in overlay mode) on images in video mode.

OBJECT OF THE INVENTION

One obvious solution for enabling the overlay of graphic images on images in video mode would be to use a screen with a SRAM matrix type circuit and optimize the levels and the speed of addressing the memory in order to be able to display video quality images with a suitable refresh rate. However, this solution encounters a plurality of difficulties. In particular, in order to display a video image of good quality, as a minimum an coding on eight bits, or even on ten bits per sub-pixel is necessary. However, with the CMOS technologies currently available (silicon wafer of 200 mm, with a resolution of 130 nm), this leads to pixel sizes that are much too large. By way of example, a sub-pixel such as described in the article by Vogel et al, cited above, with only four bits of levels measures 12 μm×12 μm, whereas the AMOLED screens such as described in the publication by Wacyk et al., cited above, currently have sub-pixels of a size in the order of 4 μm×4 μm.

According to the invention the problem is solved by using a matrix of elementary electroluminescent emitting zones that has two addressing modes: a first mode (known as "video mode") using a video type interface, preferably standardized, which makes it possible to display video images of good quality (with typically eight to ten bits of gray levels and a good refresh rate (also known as refresh frequency), typically between 30 Hz and 120 Hz, preferably between 60 Hz and 120 Hz), but that does not need to keep the image in permanent memory, and a second mode (known as "graphic mode") using a data type interface, preferably standardized (for example of SPI type) that keeps the image in memory, knowing that said graphic mode only requires a small number of gray levels (for example one or two bits per sub-pixel), and that the image stored in memory may either be displayed alone, or overlaid with a video image entered in the display unit by the video interface. It is noted that the expression "gray level" designates here an emission intensity level by an elementary electroluminescent emitting zone, regardless of the color of said emission. Each elementary electroluminescent emitting zone may be a sub-pixel or a pixel. Each elementary electroluminescent emitting zone has two independent memories: a static memory, advantageously of SRAM type, intended for graphic data, and a dynamic, analog memory, intended for data from the video stream; said dynamic memory may be a capacity.

For the video mode, the data is synchronous data, refreshed (updated) periodically, said refresh being typically controlled by a clock.

For the graphic mode, the image may be static and reprogrammed (that is to say updated) as required (that is to say each elementary emitting zone may be refreshed by sending new data only when the content of the static memory thereof will change following said saving of the new data in said static memory), or refreshed periodically. In the first case, this concerns asynchronous data, which does not depend on a clock; in the second case, this may concern synchronous data.

When the graphic image is refreshed periodically, the rate for refreshing the image may be low, in particular lower than 0.1 Hz (or even 0 Hz); it is advantageously in the order of 0.1 Hz to 1 Hz, but may reach a frequency higher than 10 Hz. During the refresh of graphic data, the updated data is saved in all static memories at the same time, even if for some elementary emitting zones this updated data is identical to the previous data that is replaced by the newly saved data. The refresh frequency may be fixed or variable. The frequency for refreshing graphic data is independent of that for video data; it is advantageously lower, but may also be higher.

The object of the invention is an electroluminescent display unit comprising:

- a matrix of electroluminescent pixels formed from a plurality of pixels arranged on a substrate, according to a matrix arrangement in lines and columns, each pixel being formed by at least one elementary emitting zone;

a first control block configured to control a graphic and/or alphanumeric data stream that can be displayed on said matrix of electroluminescent pixels by using the static memory of the pixel;

a second control block configured to control a video data stream that can be displayed on said matrix of pixels by using the dynamic memory of the pixel;

a unit for generating a reference voltage, characterized in that:

each elementary emitting zone is connected to a static memory, addressed by said first control block, and to a dynamic memory, addressed by said second control block;

said first and second control blocks are configured to be able to display data alternately or simultaneously on the same matrix of electroluminescent pixels.

Said first and second control blocks are configured to be able to display on the matrix of pixels only the video data stream, or only the graphic and/or alphanumeric data stream, or even to overlay said graphic and/or alphanumeric data stream on said video data stream.

Said first control block is configured to send images towards the matrix of static memories of the pixels, for example via a first system of "select" lines and of "data" columns.

The first control block may comprise a clock or be controlled by a clock.

Said second control block is configured to send:

a video data stream towards a horizontal shift register that controls the system for addressing the columns provided for this purpose of the matrix of electroluminescent pixels, a command signal towards a line driving element that controls the system for addressing the lines provided for this purpose of the matrix of electroluminescent pixels, for the display of said video data stream on said matrix of electroluminescent pixels.

The second control block must comprise a clock or be controlled by a clock, the video data stream being a synchronous data stream.

According to the invention, each elementary emitting zone comprises a dynamic memory, preferably a capacity, intended for video data. Each elementary emitting zone is connected to at least one, and preferably to a plurality of (for example two or three), static memories, preferably of SRAM type, intended for the static display or with a lower refresh rate and/or with a lower number of intensity levels; said data may be graphic and/or alphanumeric data, static images or video data with temporal and/or visual resolution lower than the video data passing through the dynamic memory.

In a preferred unit of the invention, said first and second control blocks are configured so that said first control block has a number of bits of emission intensity levels lower than same of said second control block. Advantageously, said first control block is configured on three to eight bits of emission intensity levels, and/or said second control block is configured on at least eight bits of emission intensity levels; for example the second control block may be configured on ten, twelve or even fourteen bits of emission levels. Advantageously, said second control block has a refresh rate higher than same of said first control block. Said refresh rate is preferably of at least 25 Hz, more preferably of at least 30 Hz, even more preferably of at least 60 Hz, and optimally of at least 90 Hz, and/or said second control unit includes a memory unit for storing said graphic and/or alphanumeric data for a static display.

DESCRIPTION OF THE FIGURES

The invention will be described hereafter, with reference to the appended drawings, given only by way of non-limiting examples, wherein.

Figure 1:
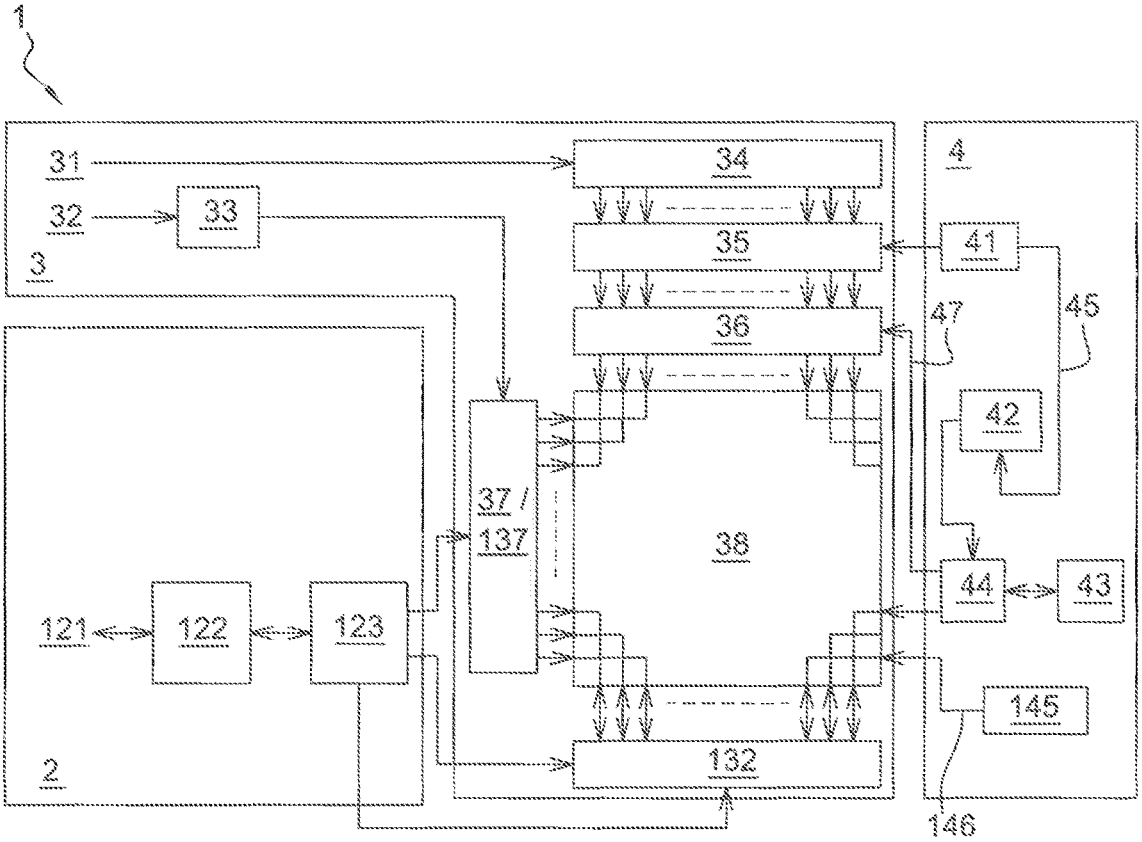
FIG. 1 is a general view of the architecture of the display element illustrating an installation for the display of a video stream and/or of graphic data.

The following numerical references are used in the present description

| | | | |
|---|---|---|---|
| 1 | Installation according to the invention | 2 | First control block |
| 3 | Second control block (management of the video stream) | 4 | Reference voltage generation unit |
| 31 | Video stream | 32 | Command signal |
| 33 | Sequencer | 34 | Horizontal shift register |
| 35 | Digital comparator | 36 | Sampling and maintenance circuit |
| 37 | Vertical shift register | | |
| 38 | Matrix of pixels | 41 | Counter module |
| 42 | Look-up table | 43 | Current source |
| 44 | Reference voltage generator | 45 | Signal from 41 |
| | | 47 | Reference voltage output from 44 |
| 121 | Serial data bus | 122 | Decoder module |
| 123 | Signal processor | 131 | Data signal |
| 132 | Horizontal addressing table | 133 | Horizontal addressing signal |
| | | 134 | Vertical addressing signal |
| 137 | Vertical addressing table | 145 | PWM signal generator |
| 146 | Control signals | 147 | Reference voltages |
| 200 | Electric circuit of a sub-pixel | 205 | Transistor |
| | | 210 | Capacitor |
| 215, 220 | Transistor | 235, 240, 245, 250 | Transistor |
| 270 | Dynamic portion of the circuit 200 | 255, 260 | Static memory (SRAM or register) |
| | | 280 | Static portion of the circuit 200 |
| 300 | Installation according to the invention | 290 | Sub-pixel |
| 310 | Capacitor | 305 | Transistor |
| 325 | OLED element | 315, 320 | Transistor |
| 355, 360 | Static memory (SRAM cell or register) | 345, 350 | Transistor |
| | | 370 | Dynamic portion of the circuit 200 |

-continued

| | | | |
|---|---|---|---|
| 380 | Static portion of the circuit 300 | 390 | Sub-pixel |
| 400 | Installation according to the invention | 405, 415 | Transistors |
| 410 | Capacitor | 420, 435 | Transistor |
| 425 | OLED element | | Transistor |
| 470 | Dynamic portion of the circuit 400 | 440, 445 450, 455, 460 | |
| 480 | Static portion of the circuit 400 | 441, 446, 451, 456 | Static memory (SRAM or register) |
| 490 | Sub-pixel | | |
| 500 | Installation according to the invention | 505 | Static memory (SRAM or register) |

DETAILED DESCRIPTION

FIG. 1 relates to two different display modes that are implemented on a single matrix of electroluminescent elementary emitting zones, which bears the reference 38 in FIG. 1. In particular, it may concern a matrix of pixels of OLED type, and the present description refers to this case, knowing that the present invention also applies to a matrix of electroluminescent pixels using inorganic semiconductors or light-emitting diodes (LED). For a matrix of pixels of a monochrome electroluminescent screen, each elementary emitting zone in general corresponds to a pixel; for a color screen each pixel breaks down into a plurality of individual addressing sub-pixels, and said sub-pixels then correspond to elementary emitting zones.

FIG. 1 describes a general view of the architecture of an installation 1 according to the invention that is provided with two separate image channels, namely a channel referred to as video (with an incoming stream of digital data) and a channel of data referred to as graphic (with an incoming stream of digital data). Said two channels are connected in the pixel only; each of the video and graphic channels have their own addressing system and a distinct wiring at the elementary emitting zone. Said architecture is designed to control each elementary emitting zone (i.e. each OLED sub-pixel) in steady current, but same may also be applied to a voltage control, by means of minor modifications (not shown in the figures). In the video channel, for each elementary emitting zone the incoming digital video signal is converted into an analog signal corresponding to the gray levels thanks to a system that comprises a counter, a current source, a reference voltage generator, and optionally a correction table, associated with comparators at the columns. The analog video signal thus obtained is temporarily stored in a dynamic memory associated with the elementary emitting zone. The graphic data channel addresses a direct-access digital live memory matrix of SRAM type via a writing procedure (and optionally also reading) for said type of memory.

More specifically, the video block of the unit comprises a counter (for example eight bits) and a comparator at the end of each column that compares the values of the counter with the video data. At the same time, the counter supplies a system of weighted current sources (namely a reference voltage generator). When the values of the counter and of the video data are equal, the reference voltage of the generator is firstly transferred into the buffer memory of the column, and subsequently during the following cycle into the elementary emitting zone, via the column. Between the counter and the reference voltage generator, there may be a conversion table for applying a non-linear correction (gamma factor); in this case it may be useful to have a greater number of bits in the reference voltage generator.

The reference voltage generator generates a voltage that introduces into the elementary emitting zone a current proportional to the value applied to the input.

Figure 2A:
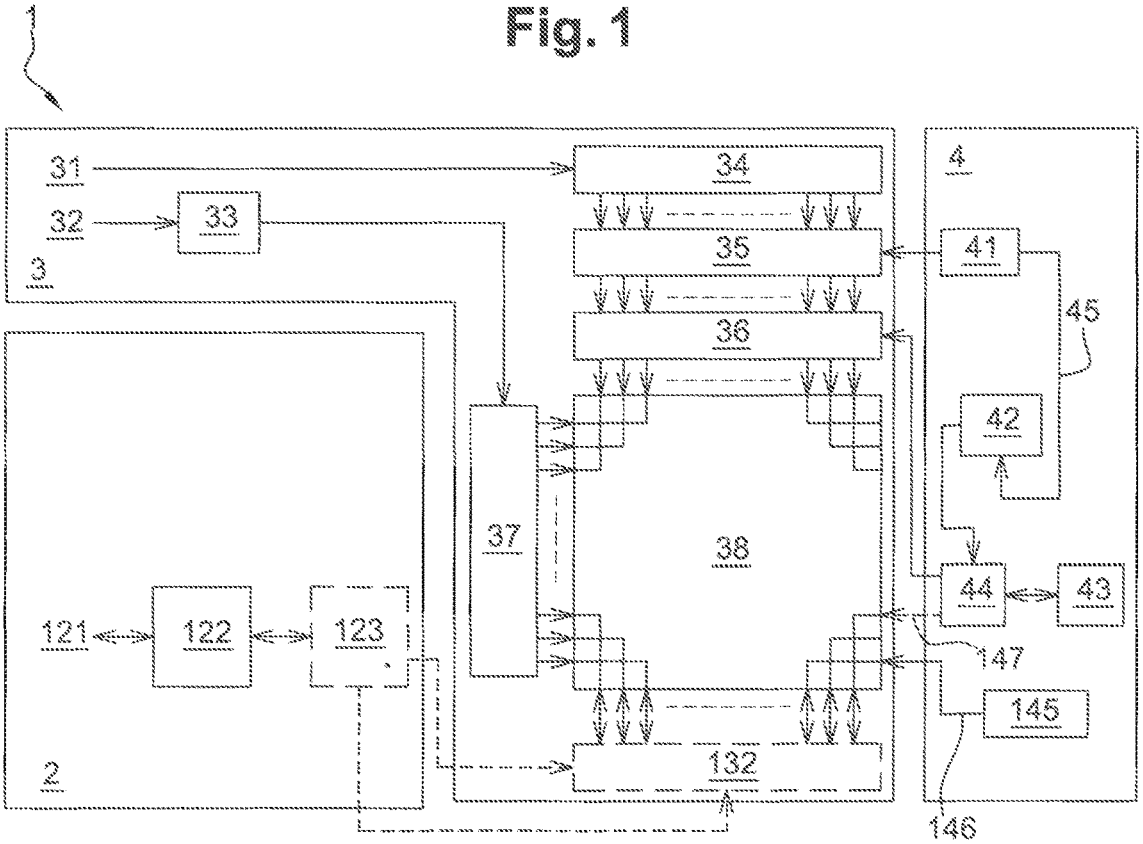
FIG. 2*a* is a general view of the architecture of the display element illustrating an installation for the display of a video stream.

FIG. 2*a* shows the circuit of the video channel for the display of a video stream 31 on the matrix of electroluminescent pixels 38. This figures shows a first block known as control block 2 that will not be used in said display mode and whereof the operation will be explained below in relation with the second display mode. A second block 3 makes it possible to manage the video stream 31 up to the display thereof on the matrix of pixels 38. Said video stream 31, which is a digital data stream, is sent towards a horizontal shift register demultiplexer 34 then towards a digital comparator 35 (that generates an analog data stream) then towards a sampling and maintenance circuit 36 and finally towards the vertical gates of the matrix of pixels 38. In said second block 3, a control signal 32 is sent to a sequencer 33 that makes it possible to supply a line driving element 37 (typically a vertical shift register or a demultiplexer) that gives the orders on the horizontal lines of the matrix of pixels 38.

A reference voltage generation unit 4 generates the reference voltage. Same comprises a counter module with eight bits 41 that sends a signal 45 to a Look-Up Table 42 (known under the acronym "LUT"), optional but recommended, which makes non-linear encoding possible. The value coming from the look-up table 42 is transmitted towards a reference voltage generator 44 coded on ten bits. Said latter comprises another input for providing a current source 43 weighted on ten bits. The output reference voltage 47 of the voltage generator 44 supplies the sampling and maintenance circuit 36 of the second control block 3.

The operation related to FIG. 1 is based on a digital video data stream 31 that is converted by a digital comparator assembly 35, counter 41, look-up table 42 (optional) and reference voltage generator 44 into an analog signal at the end of each column and transmitted to the matrix of pixels 38. Said stream type requires rapid processing for an instantaneous display. The video stream 31 is broken down by the demultiplexer 34 in order to address to each pixel of the matrix of pixels 38 the information to be displayed. The sequencer 33 transmits to the vertical shift register 37 the order for displaying the information on each pixel. Said order is based on a control signal 32 that may be of the type:

- Pixel Clock (PCLK): the pixel clock changes on each pixel.
- Horizontal synchronization (HSYNC): This is a special signal that indicates that a line of the frame is transmitted.
- Vertical synchronization (VSYNC): Said signal is transmitted after the transfer of the entire frame. Said signal is often a means for indicating that an entire frame is transmitted.

Figure 2B:
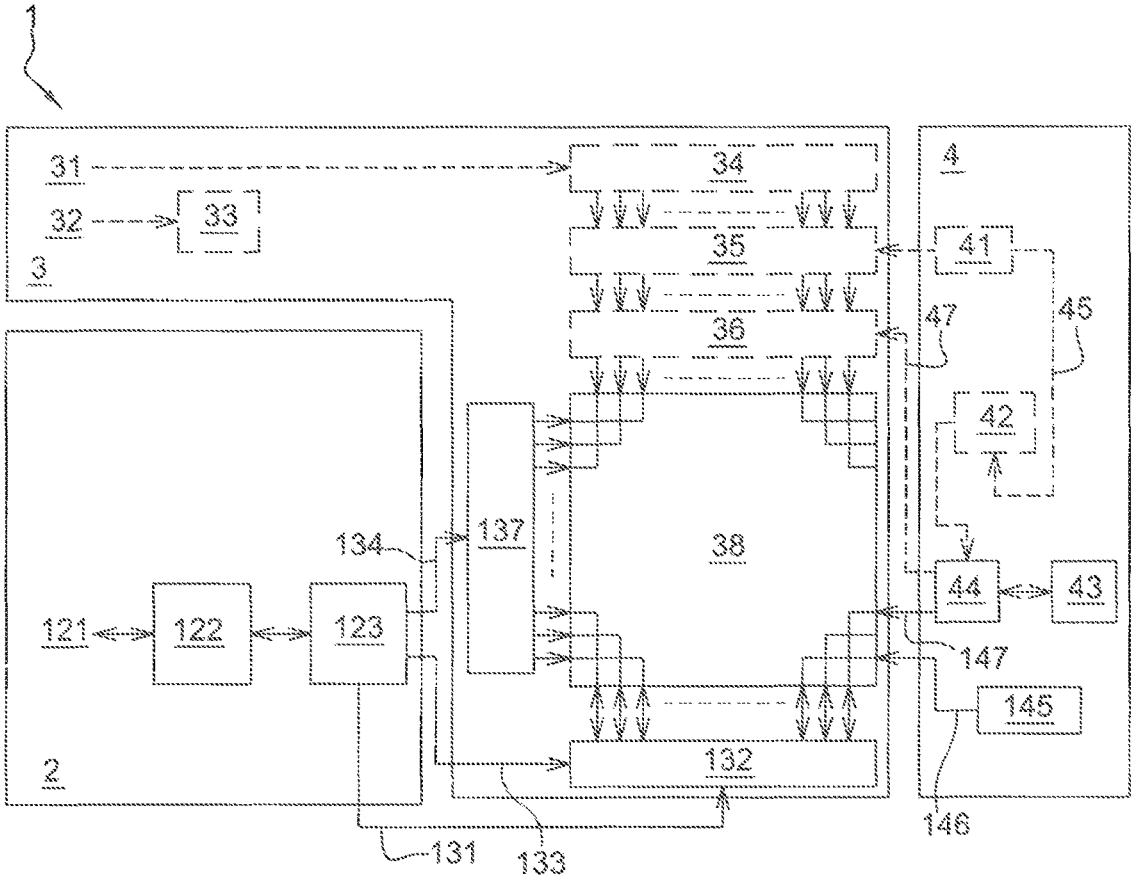
FIG. 2*b* is a general view of the architecture of the display element illustrating an installation for the display of graphic data.

FIG. 2*b* is a general view of the architecture illustrating an installation 1 for displaying graphic data on said matrix of electroluminescent pixels 38. Said architecture comprises a first control block 2, mentioned above, which comprises a serial data bus 121 transmitted towards a module 122 capable of decoding the signals and of sending same towards a signal processor 123 for decoding the signals and for sending same towards the static memories of the matrix of pixels 38, in a known manner and used in the memory circuits. Said signal processor 137 is a control unit that generates the signal of the lines and columns for the first control block 2. This may concern a signal generator or a microcontroller or also, for more complex systems, a microprocessor.

Here, we describe, for a particular embodiment, the display of said graphic and/or alphanumeric data 131 on the matrix of electroluminescent pixels 38. The first control block 2 sends the graphic and/or alphanumeric data signal 131 towards the addressing table 132 of the second control block 3. The addressing table 132 is a horizontal addressing table that controls the addressing of the columns of the matrix of electroluminescent pixels 38; same receives the horizontal addressing signal 133. The second control block 3 moreover comprises a line driving element 137 (vertical addressing table) that receives the vertical addressing signal 134 that controls the addressing of the lines of the electroluminescent display unit 38. The matrix of pixels 38 moreover receives a reference voltage coming from a unit 4 referred to as the reference voltage generation unit. Said last unit 4 comprises a reference voltage generator 44, a current source module 43 and, optionally, a Pulse Width Modulation referred to as PWM signal generator 145.

The operation related to FIG. 2*b* results in a digital processing in a slow display process and implementing at the pixel a SRAM type memory. The information is broken down in the first control block 2, all of the information, data 131 and addressing 133,134, makes it possible to display the graphic data on the matrix of pixels 38. The reference voltages 147 (here $V_{ref}$, $V_{ref1}$ and $V_{ref2}$) are generated by a reference voltage generator 44. Same define the value of the current or of the output voltage of the transistors whereof same drive the gate, and therefore of the current or of the voltage on the matrix of pixels 38. The reference voltages are therefore common to the matrix of electroluminescent pixels and give continuous signals in order to define the gray levels. Specifically, said voltages make it possible at each pixel to maintain the supply and the comparison on the values saved in the memory.

FIGS. 1, 2*a* and 2*b* correspond to implementation modes for a dynamic or static display that are distinguished by the management thereof of the data streams thus by the refresh frequency of the information displayed on the matrix of pixels. The architecture of the unit according to the invention brings together said two functions on the same matrix of pixels 38.

The architecture of the matrix of pixels 38 comprises a plurality of pixels aligned horizontally and vertically. In this embodiment, each pixel comprises four sub-pixels as elementary emitting zones; said sub-pixels may mainly be the red, the green and the blue, whereas the fourth sub-pixel may be a complement in white or any other color. Obviously, only three sub-pixels per pixel may be provided for, or even it may be provided for that each pixel is formed from only one elementary emitting zone.

As indicated above, each elementary electroluminescent emitting zone has two independent memories: a static memory, intended for graphic data, and a dynamic memory, intended for data from the video stream. FIGS. 3, 4, 5 and 7 show embodiments of circuits at an elementary electroluminescent emitting zone, whereof the structure and the operation, in particular in relation with the static or dynamic type memory units, will be explained in greater detail below.

Figure 3:
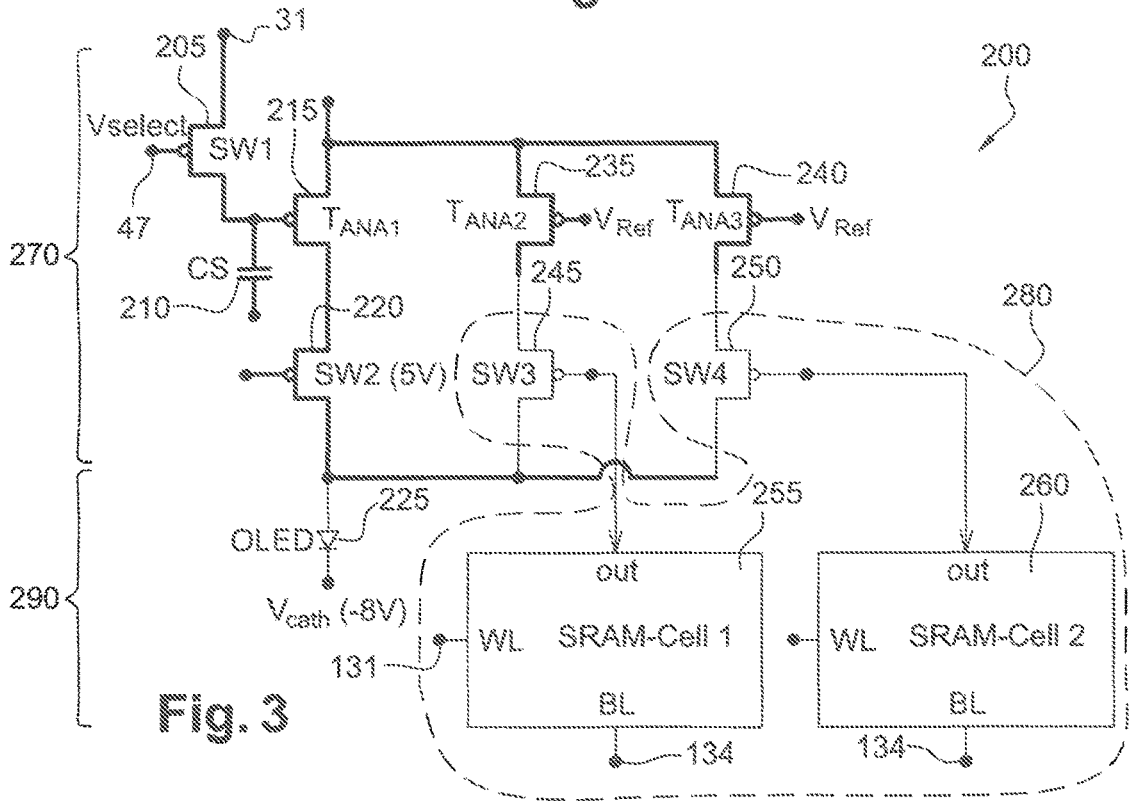
FIG. 3 is a representation of the wiring diagram of a sub-pixel for the first embodiment.

FIG. 3 shows the wiring diagram 200 of only one elementary emitting zone 290 (that may be a sub-pixel) according to a first embodiment. The circuit comprises three portions, one for the dynamic portion 270, another for the static portion 280, and the display on the sub-pixel 290.

The dynamic portion 270 of the circuit comprises the arrival of the analog video stream 31 and of a selection voltage 47 from the sequencer 33 on the gate of a transistor SW1 205. The cathode of the transistor 205 supplies a capacitor 210 as well as the gate of a transistor $T_{ANA1}$ 215. The anode of the transistor $T_{ANA1}$ 215 is connected to a voltage $V_{ANA}$. The cathode of the transistor $T_{ANA1}$ 215 is connected to the display sub-pixel 290. Said sub-pixel consists of a transistor SW2 220 connected to an OLED element 225. The transistor SW2 220 is itself also optional and makes it possible for example to modulate the emission of the OLED element 225.

The static portion 280 of the circuit (circled in FIG. 3 by a dotted line), intended for the display of graphic data, consists of a transistor $T_{ANA2}$ 235 in series with a transistor SW3 245 in parallel with a transistor $T_{ANA3}$ 240, said latter in series with a transistor SW4 250. The anodes of $T_{ANA2}$ 235 and $T_{ANA3}$ 240 are connected to the anode of $T_{ANA1}$ 215 and the cathodes of SW3 245 and SW4 250 are connected to the cathode of SW2 220 or of $T_{ANA1}$ 215 (when SW2 is optional). Each of the gates of $T_{ANA2}$ 235 and $T_{ANA3}$ 240 is connected to the reference voltage $V_{ref}$ 147. Each of the gates of the two transistors SW3 245 and SW4 250 is controlled by a SRAM cell type memory function 255,260. The memory cell is typically of six transistors type. On the diagram, only the BL ("Bit line") and WL ("Word Line") inputs, which are respectively supplied by the line addressing signal 134 (vertical addressing signal) and the data line 131, are used. The programming of the memory is carried out by establishing a digital signal, '0' or '1' on the BL column and the opposite digital signal thereof '1' or '0' on the BLB ("Bit Line Bar") column of each SRAM cell. Subsequently, a pulsed signal, in general positive, on the WL ("Word Line") signal comes to save the BL and BLB signals in the memory of the SRAM type cell.

The circuit according to FIG. 3 may be used in three different ways. The first usage is the video mode, which essentially involves the dynamic portion 270, that is to say the memory is set at level 0 everywhere in the matrix, and data is transmitted by the video interface only; in other words the pixel is only controlled by the video data channel. A video stream 31 supplies the anode of SW1 205. The transistor becomes conducting only when the voltage $V_{select}$ permits same to switch on the display sub-pixel 290. The capacitor CS 210 is optional but highly recommended: same makes it possible to limit the overload as well as the maintenance of the voltage during a time lapse on the supply to the terminals of $T_{ANA1}$ 215; thus same acts as dynamic memory. This will only occur in the case where said capacitor 210 may be operationally substituted by the carrying capacity of the transistor $T_{ANA1}$ 215, in particular in the case where the refresh frequency of the video stream is sufficiently high. The static portion 280 not being supplied in said video operating mode, no current circulates in said portion.

The second usage is the graphic mode that essentially involves the static portion 280. The memory function of the SRAM cells 245,250 makes it possible to maintain open or closed the transistors SW3 245 and SW4 250. The controlled openings of SW3 245 and SW4 250 enable the passage of the reference voltage $V_{ref}$ 147 up to the OLED element 225. The assembly of $T_{ANA2}$ 235 and $T_{ANA3}$ 240 in parallel has the function of analog to digital converter on two bits. The converter enables four possible modes as follows:

Mode 00: When the two transistors SW3 245 and SW4 250 are not conducting, the current transiting in the circuit is null, as mentioned previously in the pure dynamic mode.

Mode 01: the transistor SW4 250 is conducting, the relative current is sent to the unit for displaying the sub-pixel 290.

Mode 10: the transistor SW3 245 is conducting, the relative current is sent to the unit for displaying the sub-pixel 290.

Mode 11: the transistors SW3 245 and SW4 250 are conducting, the relative current is sent to the unit for displaying the sub-pixel 290.

The third usage is a mixed mode referred to as overlay: both a video signal by the dynamic channel 270 and a graphic signal by the static portion 280 are applied. The current in the OLED therefore corresponds to the overlay of both signals; the display of the sub-pixel 290 is controlled by the converter formed by $T_{ANA2}$ 235 in series with SW3 245 and $T_{ANA3}$ 240 in series with SW4 250 as well as $T_{ANA1}$ 215.

The diagram shown in FIG. 3 proposes an advantageous embodiment of a display with four levels (two bits) for the graphic portion by using two SRAM type memory cells 255,260; same may comprise additional memory cells (for example 3, 4 or 5 SRAM cells) that will increase the capacity of the analog to digital converter in number of bits and therefore of possible modes.

The architecture shown above is designed to supply the OLED 225 with steady current, however, same may also be applied to a voltage supply by means of minor modifications.

Figure 4:
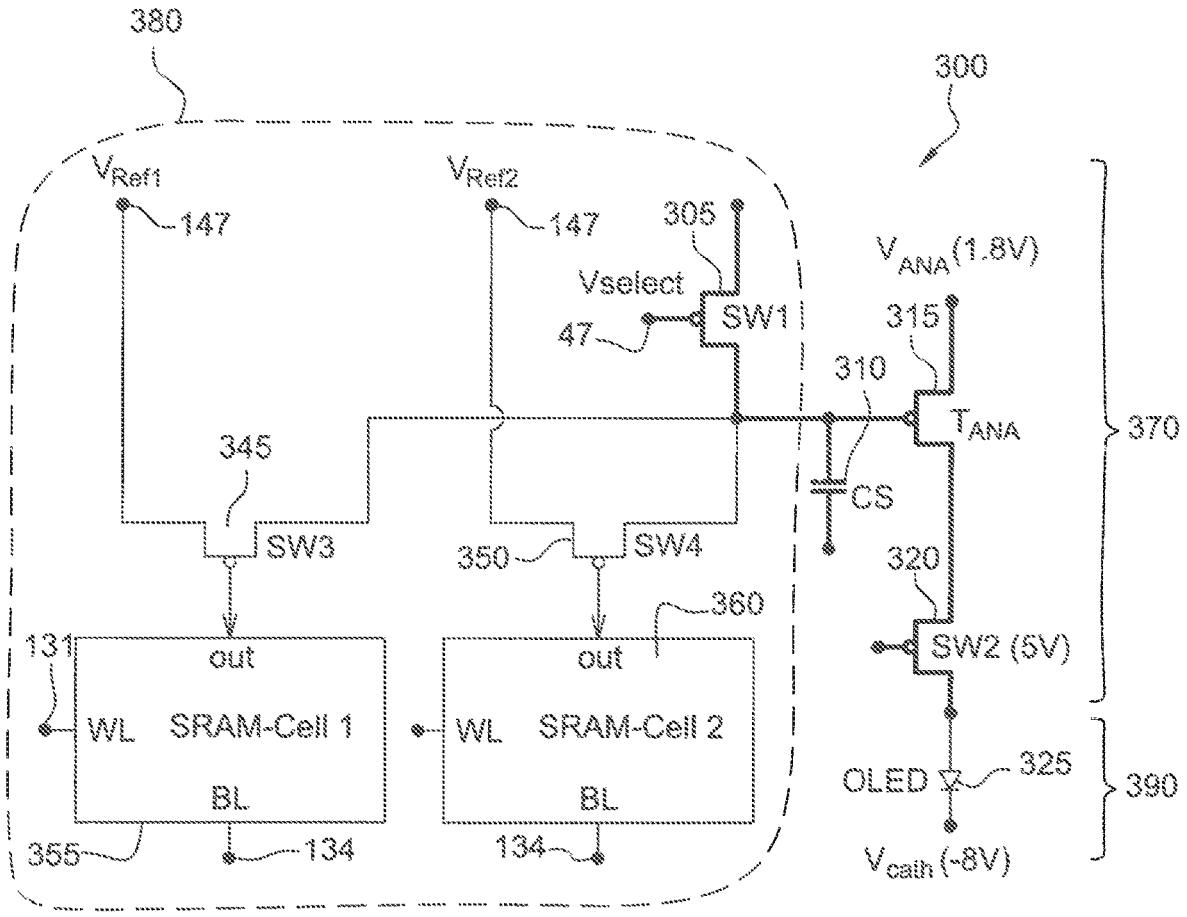
FIG. 4 is a representation of the wiring diagram of a sub-pixel for the second embodiment.

FIG. 4 describes a second embodiment 300 of the arrangement at one of the sub-pixels. The circuit comprises three portions, a first for the dynamic portion 370, a second for the static portion 380, and a third for the display on the sub-pixel 390. The dynamic portion 370 comprises the arrival of the analog video signal 31 on the anode and of a line selection voltage 47 on the gate of a transistor SW1 305. The cathode of the transistor 305 supplies a capacitor 310 (acting as dynamic memory) as well as the gate of another transistor $T_{ANA}$ 315. The anode of the transistor $T_{ANA1}$ 315 is connected to a voltage $V_{ana}$. The cathode of the transistor $T_{ANA1}$ 315 is connected to the sub-pixel 390 display. Said latter comprises a transistor SW2 320 (optional) connected to an assembly comprising the OLED element 325.

The static portion 380 (circled in FIG. 4 with a dotted line) consists of two transistors SW3 345 and SW4 350 that are connected by the cathode thereof to same of the transistor SW1 305. The anode of said two transistors is connected each respectively to a reference voltage 147 $V_{ref1}$ and $V_{ref2}$. Each of the gates of the two transistors SW3 and SW4 is controlled by a memory function of SRAM cell 355,360 type. The memory cell is of 6 transistors or more type. In FIGS. 3, 4, 5 and 7 the BL ("Bit Line") and WL ("Word Line") inputs are respectively supplied by the line address 134 and the data line 131.

The output of a SRAM cell 355,360 makes it possible to make the respective transistors 345 and 350 conducting, a predetermined voltage $V_{ref}$ is applied to the gate of the transistor $T_{ANA}$ 315 that is the current source for the OLED; there is no need for specific current sources, but it is necessary to provide one SRAM cell per level (and not per bit as in the first embodiment). This is shown in the following table for the case of four current sources: the reference voltages $V_{ref1}$ and $V_{ref2}$, when the transistors SW3 345 and SW4 350 are conducting, are on the transistor $T_{ANA}$:

| level | SRAM1 | SRAM2 | SRAM3 | SRAM4 | $V_{gate}$ ($T_{ANA}$) |
|---|---|---|---|---|---|
| 0 | 0 | 0 | 0 | 0 | Video data |
| 1 | 1 | 0 | 0 | 0 | $V_{Ref1}$ |
| 2 | 0 | 1 | 0 | 0 | $V_{Ref2}$ |
| 3 | 0 | 0 | 1 | 0 | $V_{Ref3}$ |
| 4 | 0 | 0 | 0 | 1 | $V_{Ref4}$ |

The circuit according to FIG. 4 may be used in three different ways. According to a first use mode only the dynamic portion 370 of the circuit is used. A video stream 31 supplies the anode of SW1 305. The transistor becomes conducting only when the voltage $V_{select}$ permits same to switch on the display portion 390. The capacitor CS 310 makes it possible to maintain the voltage during a time lapse on the supply of the gate of $T_{ANA1}$ 315. The static portion 380 not being supplied, no voltage circulates in said portion. According to a second use mode only the static portion 380 of the circuit is used. The memory function of the SRAM cells 345,350 makes it possible to maintain open or closed the transistors SW3 345 and SW4 350.

According to the number of memory cells present in the circuit, the display portion 390 reacts to the various voltages applied on $T_{ANA}$ 315, as indicated for example in the table above.

In this use mode, the voltage state of the gate of the transistor $T_{ANA}$ is not necessarily known and it may be in a case of high impedance, in which case the transistor remains blocked. In order to overcome this problem, the applicant proposes to use a voltage $V_{select}$ in order to initialize the transistor $T_{ANA}$. For this in the case of a graphic mode only, the voltage $V_{select}$ is not controlled by the sequencer 33 but comes from the reference voltage generation unit 4.

The signal of the voltage $V_{select}$ makes it possible to reinitialize the transistor $T_{ANA}$ before each write in the memory cells.

The third use mode is a mixed mode referred to as overlay, which involves both the static portion 280 and the dynamic portion 270 of the circuit. The display of the sub-pixel 290 is controlled by the converter formed by $T_{ANA}$ 315. In this case, the display portion 390 allows both the video signal 31 and the stream coming from the various memory cells 355,360 to pass through.

As indicated above, here circuits are described wherein the display of the sub-pixels 290 is controlled by the current, but the circuits may be controlled in voltage by means of minor modifications.

Figure 5:
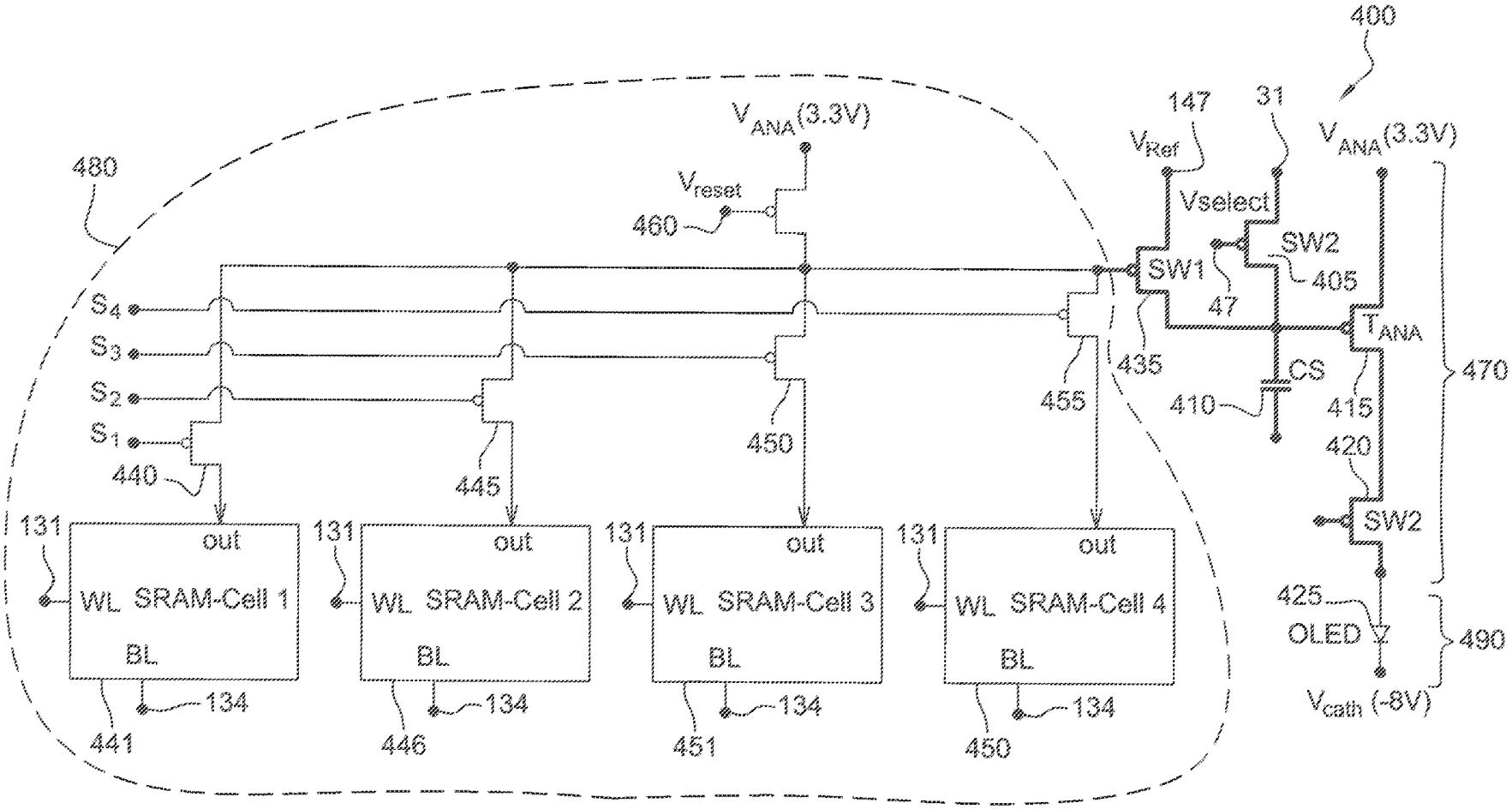
FIG. 5 is a representation of the wiring diagram of a sub-pixel for the third embodiment.

FIG. 5 describes the third embodiment 400 of the arrangement of the circuit at one of the sub-pixels, for a particular case with four bits of gray levels. The circuit comprises three portions, a first portion 470 for the dynamic display, a second portion 480 for the static display, and a third for the display on the sub-pixel 490. The dynamic portion 470 comprises the arrival of the analog video signal 31 on the anode of a transistor SW2 405 and of a line selection voltage 47 on the gate of the transistor SW2 405. The cathode of the transistor 405 supplies a capacitor 410 (acting as dynamic memory) as well as the gate of a transistor $T_{ANA}$ 415. The anode of the transistor $T_{ANA}$ 415 is connected to a voltage $V_{ANA}$. The cathode of the transistor $T_{ANA}$ 415 is connected to the sub-pixel 490 display. Said latter consists of a transistor SW2 420 connected to the OLED element 425. The static portion 480 (circled in FIG. 5 with a dotted line) consists of a transistor SW1 435 that is connected by the cathode thereof to the gate of the transistor $T_{ANA}$415. The anode of the transistor SW1 435 is connected to a reference voltage $V_{ref}$ 147. The cathode of the transistor SW1 435 is controlled by five signals coming from the anode of transistors 440, 445, 450, 455, 460 arranged in parallel.

In this embodiment and by way of example comprising four bits of gray levels, the four control signals 146, S1, S2, S3, S4 control the gates of the four transistors 440, 445, 450, 455 that make it possible to transmit data coming from the cell memories 441, 446, 451, 456 respectively arranged on the anode thereof towards the gate of SW1 435. The fifth transistor 460 is connected by the cathode thereof to the anode of SW1 435 and comprises an analog supply $V_{ANA}$ on the anode thereof and a signal $V_{reset}$ on the gate thereof. The memory cell may be of type with six transistors or more. The sub-pixel 425 of the display portion 480 operates with only one level of luminance, therefore it is by controlling the emission time of said latter that the gray levels are produced.

The circuit according to FIG. 5 may be used in three different ways. According to a first use mode only the dynamic portion 470 of the circuit is used. A video stream 31 supplies the anode of SW2 405. The transistor becomes conducting only when the voltage $V_{select}$ (coming from the module 33) permits same to switch on the display portion 490. The capacitor CS 410 makes it possible to maintain the voltage during a time lapse on the supply to the terminal of $T_{ANA}$ 415. The static portion 480 transmits the signals S1, S2, S3 and S4 with a logic level at 1, and the level of the memory cells therefore has no effect on the voltage of the sampling capacity of the capacitor CS 410 and therefore on the video signal 31.

According to a second use mode only the static portion 480 of the circuit is used. The writing in the memory cells 441, 446, 451, 456 is carried out completely randomly. In order to prevent any effect of visible flicker at the display portion 490, the refresh frequency of the signal must be higher than 85 Hz or lower than 12 ms. It is preferable to use an even higher frequency, around 120 Hz, in order to limit the interferences concerning the writing time and emission of the memory cells. In this use mode, the voltage state of the gate of the transistor $T_{ANA}$ is not necessarily known and it may be a case of high impedance, in which case the transistor remains blocked. In order to overcome this problem, the applicant proposes to use a voltage $V_{select}$ in order to initialize the transistor $T_{ANA}$. For this in the case of a graphic mode only, the voltage $V_{select}$ is not controlled by the sequencer 33 but comes from the reference voltage 147 generator 44.

The signal of the voltage $V_{select}$ makes it possible to reinitialize the transistor $T_{ANA}$ before each write in the memory cells.

The third use mode is a mixed mode referred to as overlay, which involves both the static portion 480 and the dynamic portion 470 of the circuit. The dynamic portion 270 sends the video signal 31 on the sampling capacity CS 410. The voltage level on the capacity may be forced by the data coming from the memory cells 441, 446, 451, 456 that will force the display of the static portion 480 on the video stream 31 of the dynamic portion 470. The voltage $V_{select}$ takes the features of the signal of the sequencer 33 through the vertical shift register 37.

Figure 6:
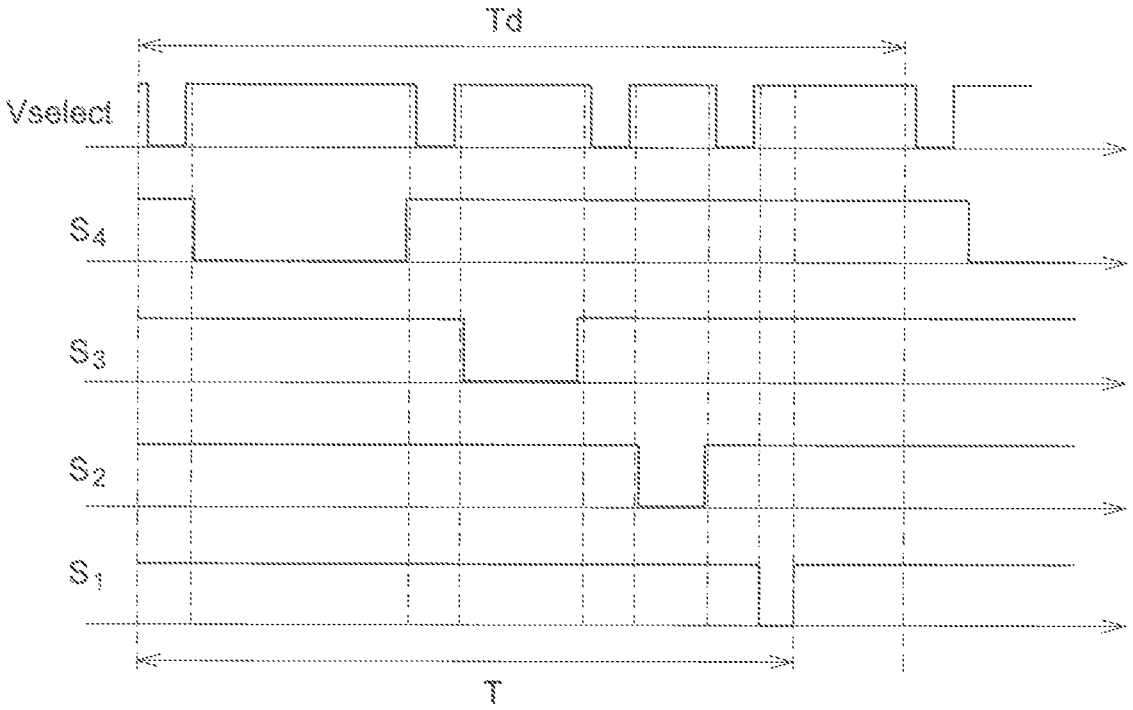
FIG. 6 is a timing chart of control signals of the emission time applied to inputs S1 to S4 of the pixel circuits.

FIG. 6 describes a timing chart of control signals 146 of the emission time applied to inputs S1 to S4 of the pixel circuits to block the transistor $T_{ANA}$ between 2 conductions. Said timing chart is shown by way of example. Same comprises four bits of gray levels modulated by the four control signals 146, S1, S2, S3, S4. The timing chart describes the control signals S1, S2, S3, S4 by bit of gray level. The emission time generated by S1 corresponds to the first gray level, S2 to the second bit of gray level up to S4. The maximum luminance is reached if S1, S2, S3 and S4 are at 1. A means can be added to vary the luminance via the T/Td ratio; the gray levels remain at 1. The control signals 146 that control S1, S2, S3, S4 are generated by the reference voltage generation unit 4 and more particularly by the pulse width modulation (abbreviated PWM) type signal generator 145.

FIG. 6 also shows the signal of the voltage $V_{select}$. Said modulated signal indeed makes it possible to reinitialize the gate of $T_{ANA}$ before each writing in the memory cells. This signal applies to the last two embodiments.

The diagram shown proposes an advantageous embodiment, however, it may consist of additional memory cells in order to increase the number of gray levels.

Figure 7:
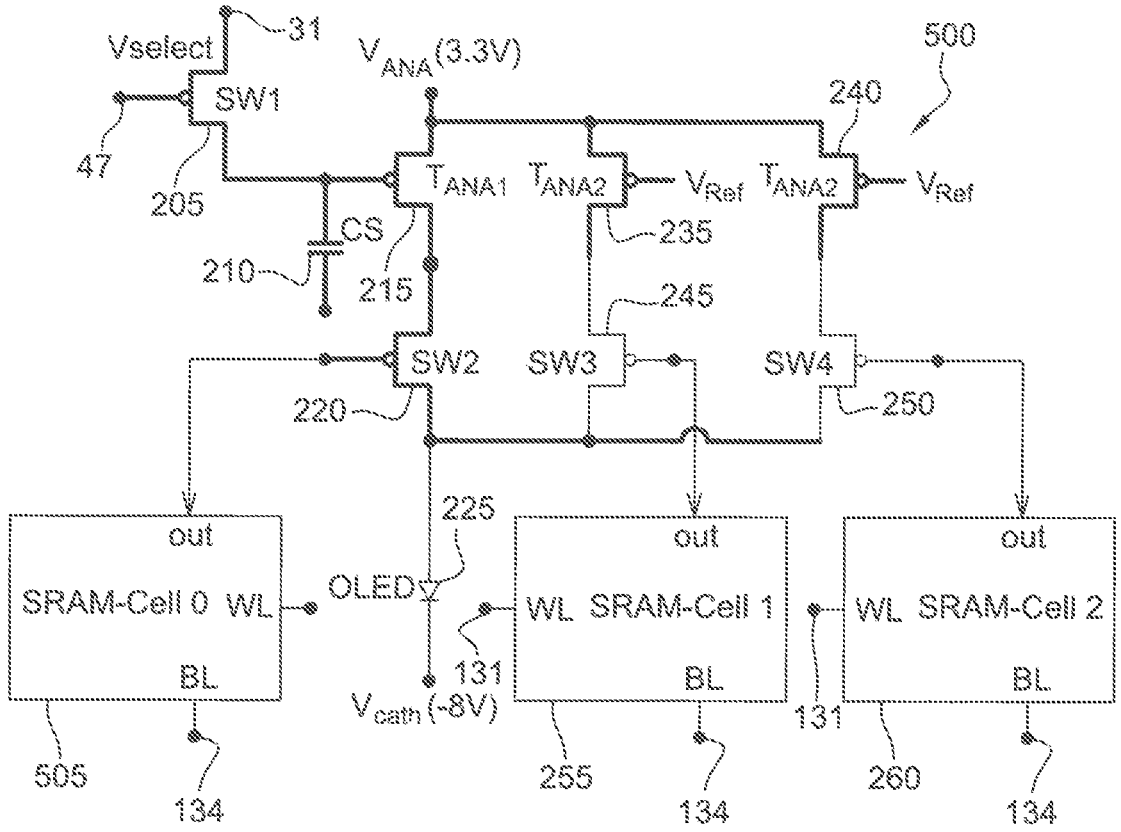
FIG. 7 is a representation of the wiring diagram of a sub-pixel having an alternative embodiment.

FIG. 7 shows a variant 500 of the first embodiment but able to be given in three embodiments. Said variant consists in adding a memory cell 505 connected to the gate of SW2 in each of the embodiments. Regardless of the polarization mode of the OLED, in voltage or in current, and regardless of the embodiment implementing SRAM type memories, said memory cell makes it possible to switch off the video data of the pixel to only leave the graphic channel on the pixel. This modification makes it easier to implement the overlay mode. All of the embodiments make use of reference voltages or intensities 47 that are ideally generated by the reference voltage generation unit 4. It is possible to generate said reference intensities or voltages locally via supply or analog/digital converter voltages. Said choice involves integrating on each assembly of sub-pixels electrical elements for constructing said reference voltages.

All of the embodiments use OLED current driving. For voltage driving, all of the transistors shown of the PMOS type must be replaced by NMOS transistors.

The voltage $V_{ANA}$ is typically in the order of 1.0 V to 3.3 V (for example 1.8 Volt), the voltage $V_{cath}$ is typically in the order of −2 V to −9 V (for example −8 Volt).

When the screen is configured to display graphic data at the same time as video data, the graphic data may have either the priority (in the embodiment shown in FIG. 4) or overlay (in the embodiments shown in FIGS. 3, 5 and 7); in said last case the currents in the OLED diode are added together.

More specifically, in the embodiment described in relation with FIG. 4, during the writing of the pixel by the signal $V_{select}$, the reference voltages $V_{ref1}$ and $V_{ref2}$ connected to the graphic data by the transistors SW3 and SW4 are balanced with the voltage 305 controlled by the block 36. After the writing, the transistor SW1 is open and therefore the graphic value is written on the capacity CS and therefore takes the priority over the video signal. It follows that in said operating mode the voltages $V_{ref1}$ and $V_{ref2}$ are likely to vary, which may, in some cases, lead to a visible effect on the graphic display. Said effect may be minimized if the impedance of the block 37 is much lower than same of the block 36, because in this case the driving by the voltages $V_{ref1}$ and $V_{ref2}$ takes precedence over the driving by the video voltages 305.

The invention claimed is:

1. An electroluminescent display unit comprising:

a matrix of electroluminescent pixels formed from a plurality of pixels arranged on a substrate, according to a matrix arrangement in lines and columns, each pixel being formed by at least one elementary emitting zone each elementary emitting zone being connected to a static memory and a dynamic memory;

a first control block configured to control a graphic and/or alphanumeric data stream that can be displayed on said matrix of pixels;

a second control block configured to control a video data stream that can be displayed on said matrix of pixels, said video data stream being refreshed periodically, wherein second control block and said refresh of said video data stream are controlled by a clock;

a unit for generating a reference voltage, knowing that said data stream may be static and reprogramed as required, or refreshed periodically with a refresh frequency independent from same of said video data stream, wherein each elementary emitting zone is connected to a static memory, addressed by said first control block, and to a dynamic memory, addressed by said second control block;

wherein said first and second control blocks are configured to be able to display data alternately or simultaneously on the same matrix of pixels;

wherein each elementary emitting zone is connected to a static memory intended for graphic and/or alphanumeric data; and wherein said static memory controls a gate of a transistor, said transistor defining a current in an organic light-emitting diode (OLED) element using a reference voltage.

2. The unit according to claim 1, wherein said first and second control blocks are configured to be able to display on the matrix of pixels only the video data stream, or only the graphic and/or alphanumeric data stream, or even to overlay said graphic and/or alphanumeric data stream on said video data stream.

3. The unit according to claim 1, wherein said dynamic memory to which each elementary emitting zone is connected is a capacity.

4. The unit according to claim 1, wherein said first control block is configured to allow a refreshing of an image by sending new data only when a content of said static memory changes following a saving of new data in said static memory.

5. The unit according to claim 1, wherein said first control block is configured to send:

towards an addressing table that controls the addressing of the static memories of the matrix of electroluminescent pixels:

a graphic and/or alphanumeric data signal, a horizontal addressing signal;

towards a line driving element an addressing signal that controls the addressing of the lines of the electroluminescent display unit, for the display of said graphic and/or alphanumeric data on said matrix of electroluminescent pixels.

6. The unit according to claim 1, wherein said second control block is configured to send:

a video data stream towards a horizontal shift register that controls the addressing of the columns of the matrix of electroluminescent pixels, a control signal towards a line driving element that controls the addressing of the lines of the matrix of electroluminescent pixels, for the display of said video data stream on said matrix of electroluminescent pixels.

7. The unit according to claim 1, wherein said first and second control blocks are configured so that said first block has a number of bits of emission intensity levels higher than same of said second control block.

8. The unit according to claim 1, wherein said first control block is configured on at least eight bits of emission intensity levels, and/or said second control block is configured on two to six bits of emission intensity levels.

9. The unit according to claim 1, wherein said first control block has a refresh rate higher than same of said second control block.

10. The unit according to claim 1, wherein said first control block has a refresh rate higher than or equal to 25 Hz, and/or in that said second control block includes a memory unit for storing said graphic and/or alphanumeric data for a static display.

11. The unit according to claim 10, wherein said first control block has a refresh rate higher than or equal to 60 Hz.

12. The unit according to claim 10, wherein said first control block has a refresh rate of at least 90 Hz.

13. The unit according to claim 1, wherein said second control block has a refresh rate between 0 Hz and 10 Hz.

14. The unit according to claim 13, wherein said second control block has a refresh rate between 0.1 Hz and 1 Hz.

15. The unit according to claim 1, wherein each elementary emitting zone is connected to a plurality of static memories.

16. The unit according to claim 1, wherein said static memory is of a static random access memory (SRAM), or a register type.

* * * * *